US012207782B2

(12) United States Patent
Davila et al.

(10) Patent No.: US 12,207,782 B2
(45) Date of Patent: Jan. 28, 2025

(54) FLOOR CLEANER

(71) Applicant: Techtronic Cordless GP, Anderson, SC (US)

(72) Inventors: Rafael Davila, Kannapolis, NC (US); Michael Paul Dawson, Huntersville, NC (US); Michael Bloom, Charlotte, NC (US)

(73) Assignee: Techtronic Floor Care Technology Limited, Tortola (VG)

( * ) Notice: Subject to any disclaimer, the term of this patent is extended or adjusted under 35 U.S.C. 154(b) by 341 days.

(21) Appl. No.: 17/627,010

(22) PCT Filed: Jul. 16, 2020

(86) PCT No.: PCT/US2020/042233
§ 371 (c)(1),
(2) Date: Jan. 13, 2022

(87) PCT Pub. No.: WO2021/016024
PCT Pub. Date: Jan. 28, 2021

(65) Prior Publication Data

US 2022/0273147 A1 Sep. 1, 2022

Related U.S. Application Data

(60) Provisional application No. 62/876,233, filed on Jul. 19, 2019.

(51) Int. Cl.
*A47L 9/04* (2006.01)
*A46B 3/00* (2006.01)
(Continued)

(52) U.S. Cl.
CPC ..... *A47L 9/0488* (2013.01); *A46B 3/00* (2013.01); *A46B 3/02* (2013.01); *A46B 9/02* (2013.01);
(Continued)

(58) Field of Classification Search
CPC ..... A47L 9/0488; A47L 5/30; A47L 7/0023; A47L 9/0477; A47L 9/062; A47L 9/0673;
(Continued)

(56) References Cited

U.S. PATENT DOCUMENTS 2,130,635 A 9/1938 Dow et al.
2,276,943 A 3/1942 Dow
(Continued)

FOREIGN PATENT DOCUMENTS

CN 103919508 B 1/2016
CN 102138766 B 8/2016
(Continued)

OTHER PUBLICATIONS

International Search Report and Written Opinion for Application No. PCT/US2020/042233 dated Oct. 29, 2020 (14 pages).

*Primary Examiner* — David Redding
(74) *Attorney, Agent, or Firm* — Michael Best & Friedrich LLP

(57) ABSTRACT

A cleaning head for a floor cleaner including a housing, a brushroll, a suction inlet, and a mounting plate. The mounting plate includes an edge brush adjacent the suction inlet and extending to a lateral side of the housing. The edge brush is configured to direct dirt and debris from the lateral side of the floor cleaner to the suction inlet.

23 Claims, 5 Drawing Sheets

(51) Int. Cl.

| | |
|---|---|
| ***A46B 3/02*** | (2006.01) |
| ***A46B 9/02*** | (2006.01) |
| ***A46D 1/00*** | (2006.01) |
| ***A47L 5/30*** | (2006.01) |
| ***A47L 7/00*** | (2006.01) |
| ***A47L 9/06*** | (2006.01) |

(52) U.S. Cl.
CPC ..... *A46D 1/0207* (2013.01); *A47L 5/30* (2013.01); *A47L 7/0023* (2013.01); *A47L 9/0477* (2013.01); *A47L 9/062* (2013.01); *A47L 9/0673* (2013.01); *A46B 2200/3033* (2013.01)

(58) Field of Classification Search
CPC .... A47L 11/4041; A47L 11/4088; A46B 3/00; A46B 3/02; A46B 9/02; A46B 2200/3033; A46D 1/0207
See application file for complete search history.

(56) References Cited

U.S. PATENT DOCUMENTS

| | | | |
|---|---|---|---|
| 2,824,334 | A | 2/1958 | Laningham |
| 5,475,893 | A | 12/1995 | Sepke |
| 6,094,776 | A | 8/2000 | Fish |
| 6,311,366 | B1 | 11/2001 | Sepke et al. |
| 6,421,874 | B1 | 7/2002 | McCormick |
| 6,490,755 | B2 | 12/2002 | Paterson et al. |
| 6,497,002 | B2 | 12/2002 | Paterson et al. |
| 6,499,183 | B1 | 12/2002 | Paterson et al. |
| 6,553,599 | B2 | 4/2003 | Paterson et al. |
| 6,637,067 | B2 | 10/2003 | Paterson et al. |
| 7,290,309 | B2 | 11/2007 | Rocke et al. |
| 7,409,742 | B2 | 8/2008 | Song et al. |
| 7,591,039 | B2 | 9/2009 | Kaleta et al. |
| 7,657,965 | B2 | 2/2010 | Scott et al. |
| 7,784,148 | B2 | 8/2010 | Lenkiwicz et al. |
| 7,966,690 | B2 | 6/2011 | Lenkiewicz |
| 7,979,951 | B2 | 7/2011 | Lenkiewicz |
| 7,979,955 | B2 | 7/2011 | Lenkiewicz |
| 8,146,200 | B2 | 4/2012 | Krebs et al. |
| 8,239,992 | B2 | 8/2012 | Schnittman et al. |
| 8,347,444 | B2 | 1/2013 | Schnittman et al. |
| 8,370,985 | B2 | 2/2013 | Schnittman et al. |
| 8,402,600 | B2 | 3/2013 | Beskow et al. |
| 8,438,695 | B2 | 5/2013 | Gilbert, Jr. et al. |
| 8,505,155 | B2 | 8/2013 | Lenkiewicz |
| 8,567,009 | B2 | 10/2013 | Krebs |
| 8,621,708 | B2 | 1/2014 | Lenkiewicz et al. |
| 8,671,514 | B2 | 3/2014 | Iles |
| 8,726,454 | B2 | 5/2014 | Gilbert, Jr. et al. |
| 8,726,455 | B2 | 5/2014 | Kasper |
| 8,839,477 | B2 | 9/2014 | Schnittman et al. |
| 9,078,552 | B2 | 7/2015 | Han et al. |
| 9,173,536 | B2 | 11/2015 | Van Der et al. |
| 9,314,141 | B2 | 4/2016 | Lee et al. |
| 9,392,922 | B2 | 7/2016 | Lenkiewicz et al. |
| 9,480,381 | B2 | 11/2016 | Schnittman et al. |
| 9,681,785 | B2 | 6/2017 | Kleine-Doepke et al. |
| 9,854,954 | B2 | 1/2018 | Han et al. |
| 10,070,764 | B2 | 9/2018 | Schnittman et al. |
| 10,238,260 | B2 | 3/2019 | Lenkiewicz et al. |
| 10,299,652 | B2 | 5/2019 | Gilbert, Jr. et al. |
| 2006/0000053 | A1 | 1/2006 | Lim et al. |
| 2006/0000054 | A1 | 1/2006 | Lim et al. |
| 2006/0093501 | A1 | 5/2006 | Lee et al. |
| 2007/0067946 | A1 | 3/2007 | Song et al. |
| 2007/0074371 | A1 | 4/2007 | Song et al. |
| 2008/0281470 | A1 | 11/2008 | Gilbert, Jr. et al. |
| 2010/0107356 | A1 | 5/2010 | Jakubos et al. |
| 2010/0107358 | A1 | 5/2010 | Wibbling |
| 2012/0265346 | A1 | 10/2012 | Gilbert, Jr. et al. |
| 2014/0096340 | A1 | 4/2014 | Lee et al. |
| 2017/0086631 | A1 | 3/2017 | Lee et al. |
| 2018/0116479 | A1 | 5/2018 | Gilbert, Jr. et al. |
| 2018/0325341 | A1 | 11/2018 | Xia et al. |
| 2019/0008351 | A1 | 1/2019 | Schnittman et al. |
| 2019/0090705 | A1 | 3/2019 | Thorne et al. |
| 2019/0159644 | A1 | 5/2019 | Lenkiewicz et al. |

FOREIGN PATENT DOCUMENTS

| | | | |
|---|---|---|---|
| DE | 2931183 | A1 | 2/1981 |
| DE | 7921963 | U1 | 10/1982 |
| DE | 2952147 | C2 | 5/1986 |
| DE | 4112394 | C2 | 11/2002 |
| DE | 102014102812 | A1 | 9/2015 |
| EP | 1994868 | A2 | 10/1968 |
| EP | 2201876 | B1 | 6/2016 |
| GB | 1071858 | A | 6/1967 |
| GB | 2159044 | B | 12/1987 |
| GB | 2423240 | A | 8/2006 |

FLOOR CLEANER

CROSS-REFERENCE TO RELATED APPLICATIONS

This application claims priority to U.S. Provisional Patent Application No. 62/876,233, filed Jul. 19, 2019, the entire contents of which are hereby incorporated by reference herein.

BACKGROUND

The present invention relates to floor cleaners.

SUMMARY

In one embodiment, a floor cleaner is disclosed including a housing having a front side, a rear side, a bottom side, a first lateral side, and a second lateral side. The floor cleaner further includes a suction source and a distribution nozzle configured to dispense a fluid onto a surface to be cleaned. The floor cleaner includes a brushroll chamber having an opening in the bottom side of the housing. The opening has a front edge, a rear edge, and first and second lateral edges. A brushroll is mounted in the brushroll chamber extending longitudinally between the lateral edges and extending through the opening to contact a surface to be cleaned. A suction inlet is formed between the brushroll and the rear edge. The floor cleaner further includes a recovery tank in fluid communication with the suction source and the suction inlet. The recovery tank is configured to contain the fluid drawn by the suction source through the suction inlet from the surface to be cleaned. A mounting plate is attached to the bottom side of the housing adjacent the brushroll chamber. The mounting plate includes an edge brush having a first end, a second end, and a row of bristles therebetween. The first end of the edge brush is adjacent the suction inlet and the second end of the edge brush is adjacent the first lateral side of the housing forward of the suction inlet.

In another embodiment, a cleaning head for a floor cleaner is disclosed including a housing having a front side, a rear side, a top side, a bottom side, a first lateral side, and a second lateral side. The housing includes a brushroll chamber having an opening in the bottom side. The opening has a front edge, a rear edge, and first and second lateral edges. A brushroll is mounted in the brushroll chamber extending longitudinally between the lateral edges, and extending through the opening to contact the surface to be cleaned. A suction inlet is formed between the brushroll and the rear edge of the brushroll chamber. A mounting plate is attached to the bottom side of the housing adjacent the brushroll chamber. The mounting plate includes an edge brush having a first end, a second end, and a row of bristles therebetween. The first end of the edge brush is adjacent the suction inlet and the second end of the edge brush is adjacent the first lateral side of the housing forward of the suction inlet.

In another embodiment, a cleaning head for a floor cleaner is disclosed including a housing with a front side, a rear side, a top side, a bottom side, and first and second lateral sides. The housing has a brushroll chamber having a front edge, a rear edge, and first and second lateral edges. The brushroll chamber has an opening facing the bottom side of the housing. A brushroll is mounted in the brushroll chamber extending longitudinally between the lateral edges and extending through the opening to contact a surface to be cleaned. A suction inlet is formed between the brushroll and the rear edge. A mounting plate is on the bottom side of the housing, lateral of the opening. The mounting plate includes an edge brush having a contiguous row of bristles extending from adjacent the suction inlet towards the lateral side of the housing, forward of the suction inlet.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
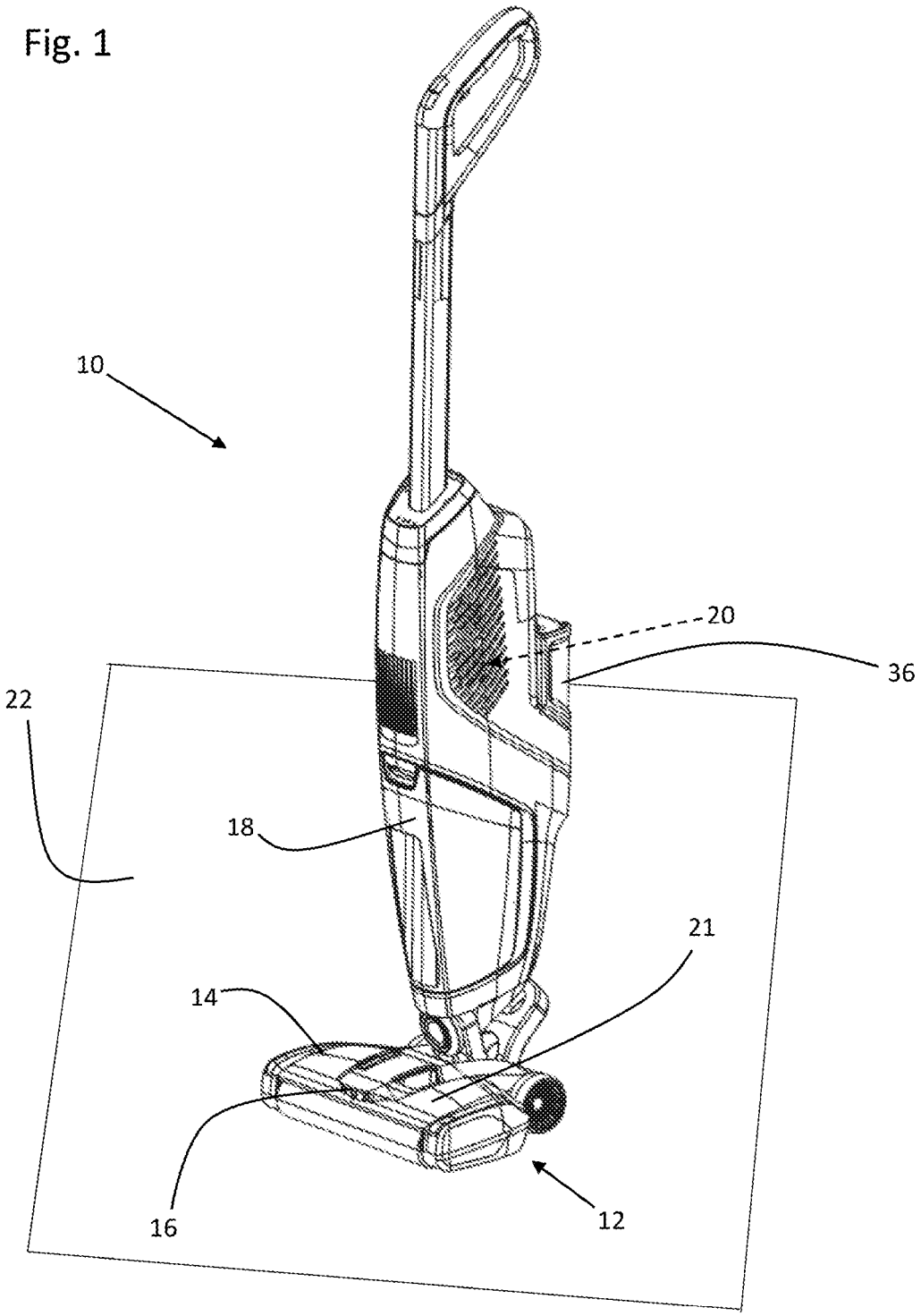
FIG. 1 is a perspective view of a floor cleaner according to one embodiment.

FIG. 1 illustrates a floor cleaner 10. In the illustrated embodiment, the floor cleaner 10 includes a cleaning head 12 having a housing 14, a brushroll 24, and a suction inlet 32 open toward a surface 22 to be cleaned. The cleaning head 12 includes an edge brush 28 extending from the suction inlet 32 toward one side of the cleaning head 12, configured to deflect debris toward the suction inlet 32. The cleaning head 12 includes a mounting plate 26 and the edge brush 28 attached to the mounting plate 26. In one embodiment, the floor cleaner 10 further includes a supply tank 36, a recovery tank 18, a distribution nozzle 16, a suction source 20, and the suction inlet 32 in fluid communication with the suction source 20. The distribution nozzle 16 is operable to dispense a fluid from the supply tank 36 onto the surface 22 to be cleaned.

The cleaning head 12 is movable over the surface 22 to be cleaned. The cleaning head 12 includes the housing 14 with a front side 17, a back side 19, a top side 21, a bottom side 23, a first lateral side 27, and a second lateral side 29. Generally, the front side 17 faces a primary or forward direction of travel of the floor cleaner 10 along the surface 22. The back side 19 is opposite the front side 17. The lateral sides 27, 29 extend from the front side 17 to the back side 19. The bottom side 23 faces the surface 22 while the top side 21 is opposite the bottom side 23.

Figure 2:
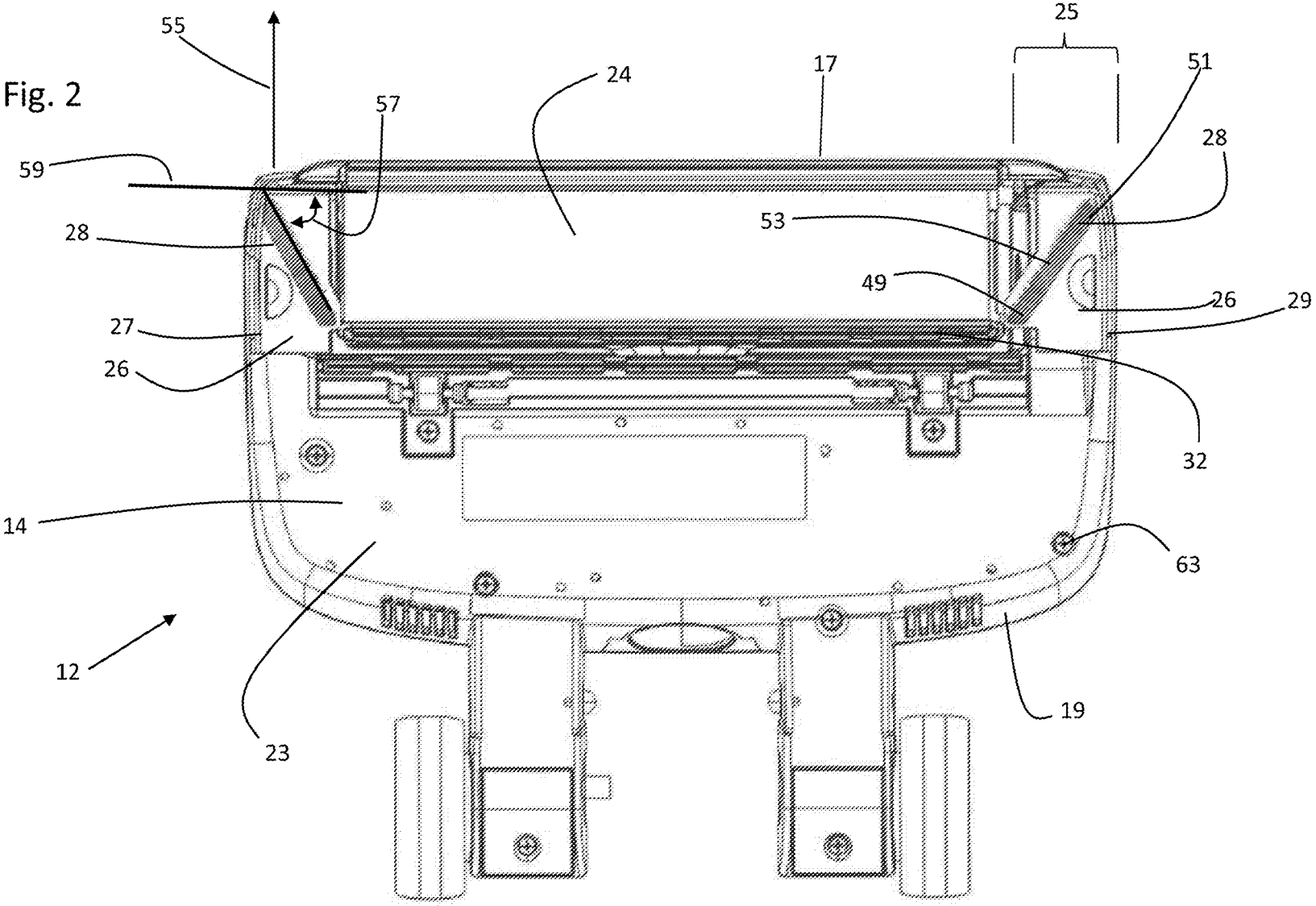
FIG. 2 is a bottom perspective view of a cleaning head of the floor cleaner of FIG. 1.
Figure 3:
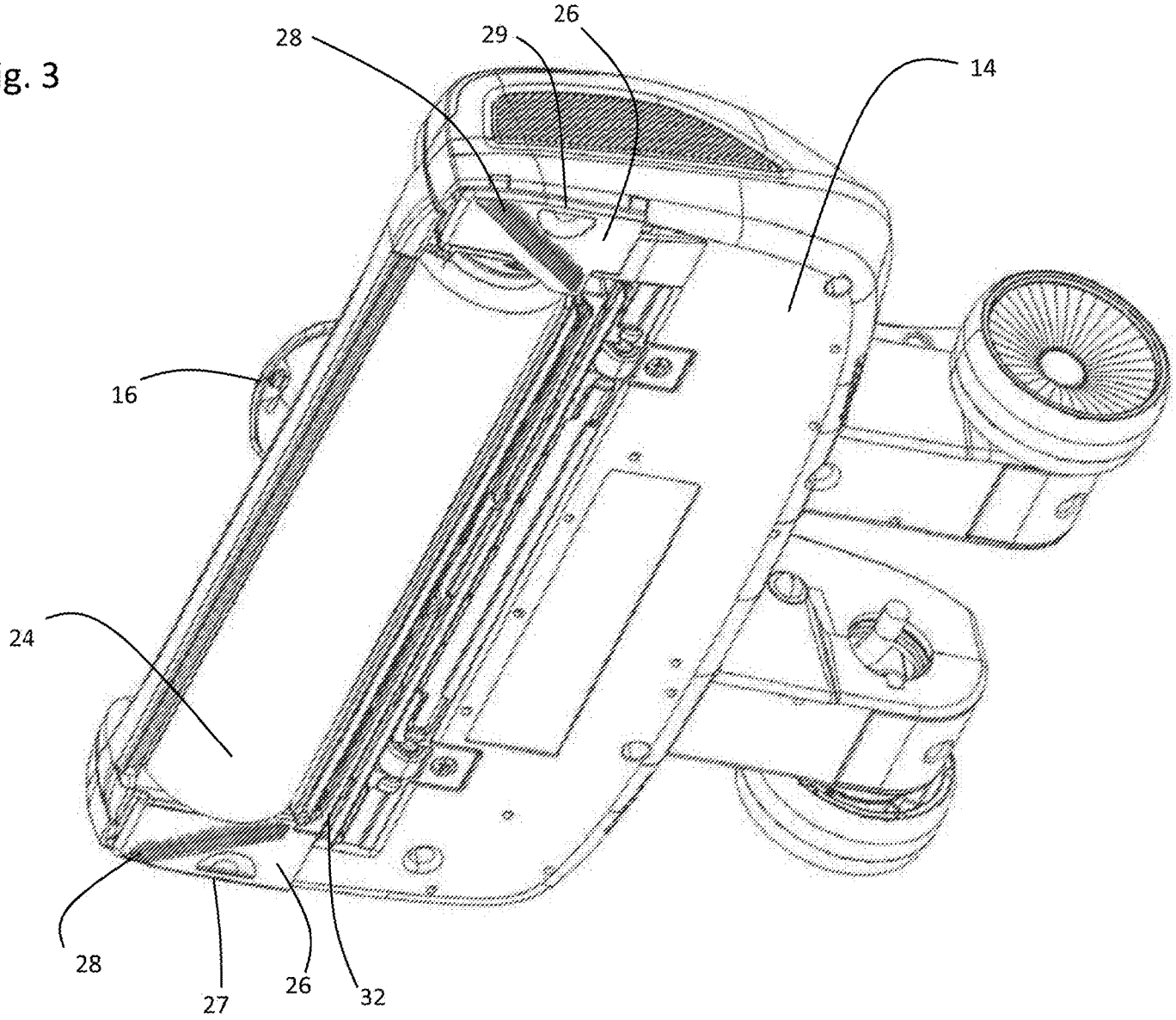
FIG. 3 is an alternate bottom perspective view of the cleaning head.
Figure 4:
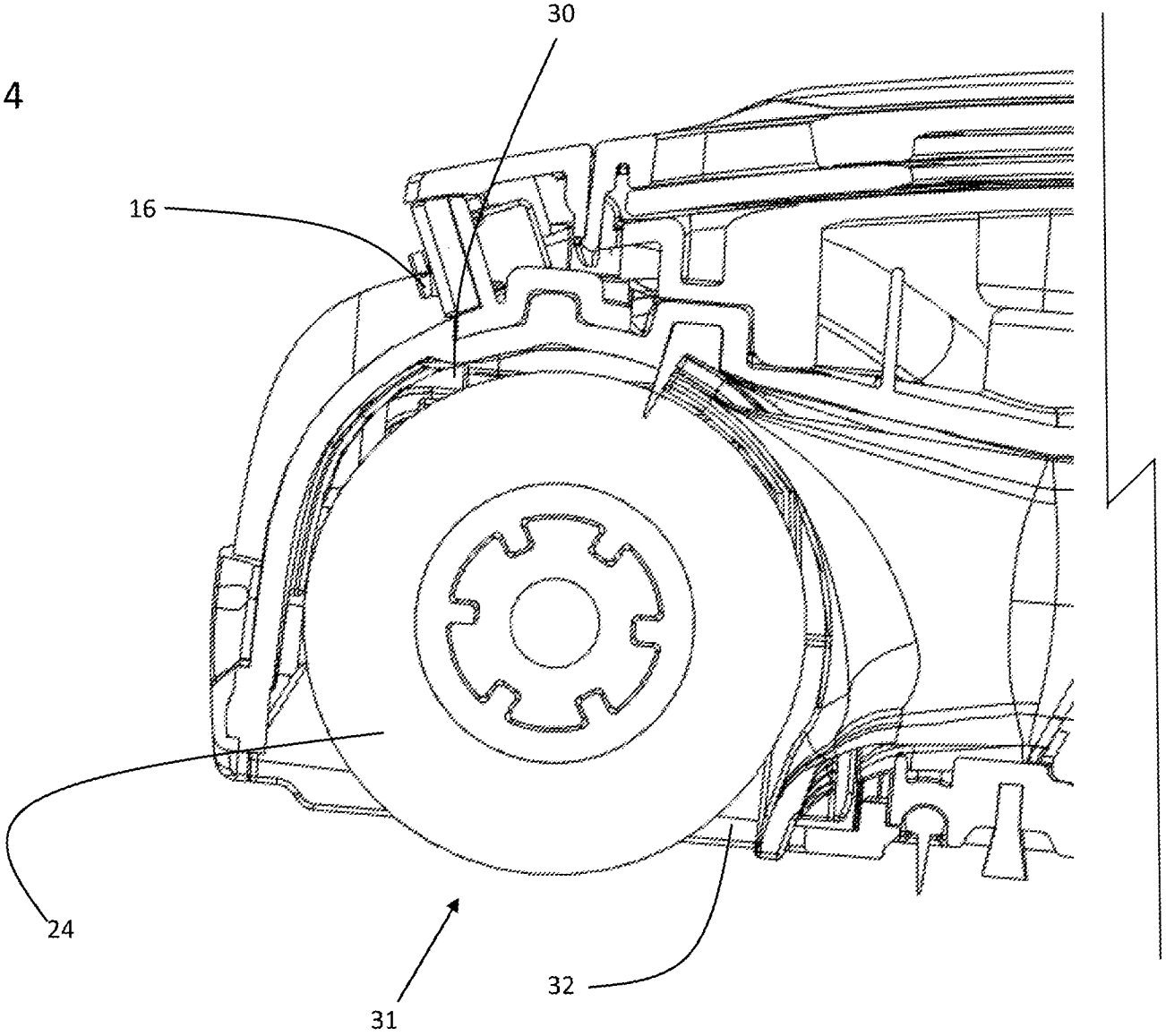
FIG. 4 is a cross-sectional view of the cleaning head.
Figure 5:
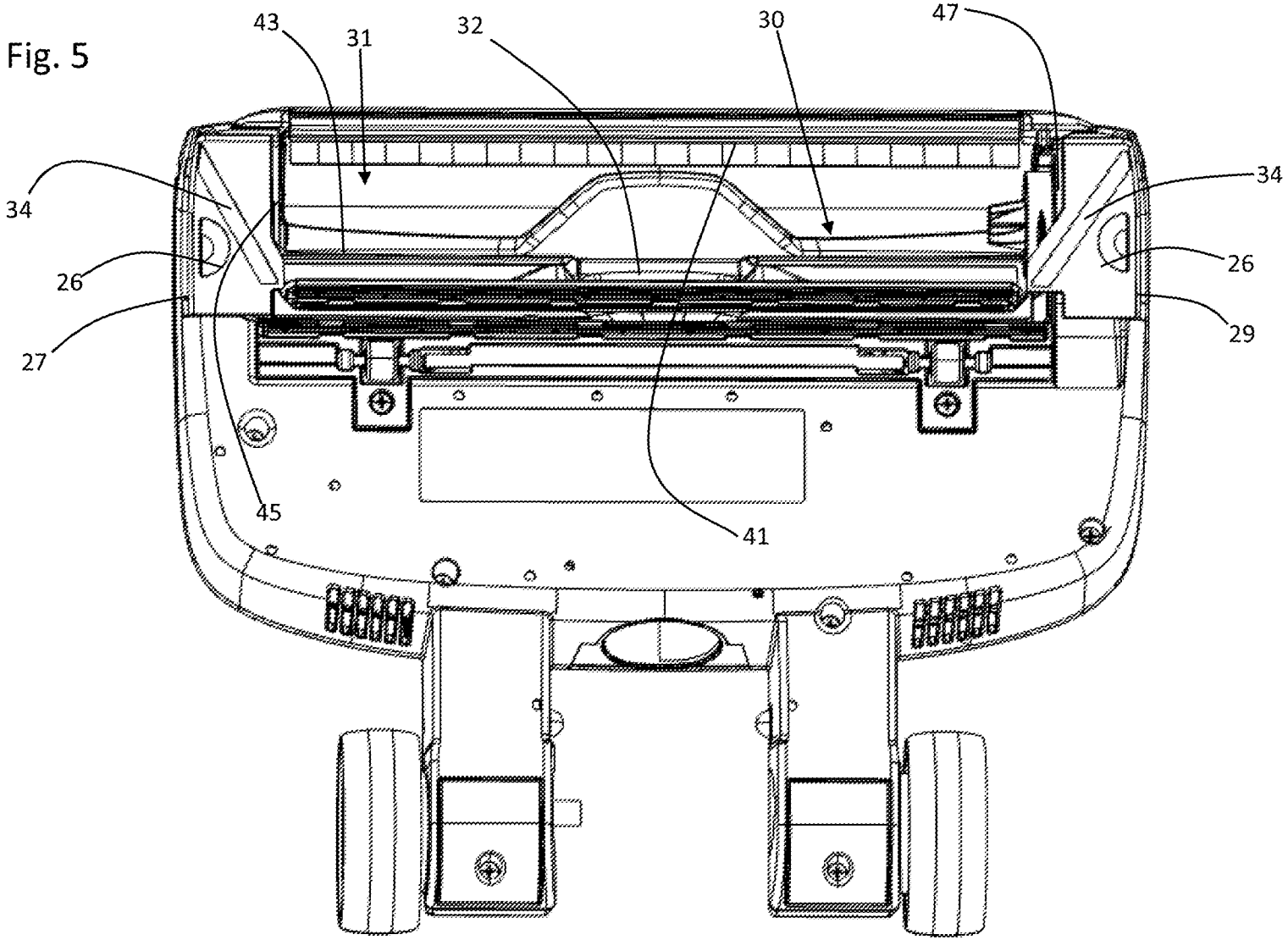
FIG. 5 is a bottom perspective view of the cleaning head, with a brushroll and edge brushes removed.

The housing 14 includes a brushroll chamber 30. The brushroll chamber 30 includes an opening 31 facing the bottom side 23. The opening 31 of the brushroll chamber 30 has a front edge 41, a rear edge 43, and a first lateral edge 45, and a second lateral edge 47. The front edge 41 is adjacent the front side 17 of the cleaning head 12 and the rear edge 41 is adjacent the back side 19 of the cleaning head 12. The first lateral edge 45 is adjacent the first lateral side 27 of the cleaning head 12 and the second lateral edge 47 is adjacent the second lateral side 29 of the cleaning head 12. The brushroll 24 is mounted in the brushroll chamber 30 extending longitudinally between the lateral sides 27, 29 of the housing 14, and extending through the opening 31 to contact the surface 22 to be cleaned (FIGS. 2-4). The suction inlet 32 is formed between the brushroll 24 and the rear edge 41 of the opening 31 of the brushroll chamber 30. The suction inlet 32 is in fluid communication with the suction source 20 and the recovery tank 18. In one embodiment, air and debris are drawn from the surface 22 through the suction inlet 32 and into the recovery tank 18. In one embodiment, the brushroll 24 and the suction inlet 32 cooperate to ingest air, fluid, and debris from the surface 22 to be cleaned. The edge brush 28 guides debris and/or fluid from the lateral side of the housing 14 to the brushroll chamber 30 and through the suction inlet 32. The cleaning head 12 may further include the distribution nozzle 16 to dispense fluid from the supply tank 36 toward the surface 22 to be cleaned.

In the illustrated embodiment, there is a space 25 between the brushroll chamber 30 and the lateral side of the housing 14 under which the brushroll 24 does not contact the surface 22 to be cleaned. In other words, the brushroll 24 and suction inlet 32 are offset from the lateral side 27 or 29 of the housing 14. The mounting plate 26 is attached to the bottom side of the housing 14 adjacent the brushroll chamber 30 (FIGS. 2-5). The illustrated mounting plate 26 is positioned in the space 25 between the brushroll chamber 30 and the lateral side of the housing 14 such that the edge brush 28 extends at least partially across the space 25 between the suction inlet 32 and the lateral side 27 or 29. The edge brush 28 has a first end 49, a second end 51, and a row of bristles 53 therebetween. In the illustrated embodiment, the first end 49 of the edge brush 28 is adjacent the suction inlet 32 and the second end 51 of the edge brush 28 is adjacent the first lateral side 27 of the housing 14 forward of the suction inlet 32. The edge brush 28 runs in a generally diagonal direction relative to the direction of forward motion (represented by arrow 55 in FIG. 2) of the cleaner 10. The edge brush 28 is angled to guide dirt from the perimeter of the floor cleaner 10 towards the suction inlet 32 as the cleaner moves in the forward direction (direction of arrow 55 in FIG. 2). Preferably, the edge brush 28 forms an angle 57 between 30 and 75 degrees with respect to axis 59 that extends parallel to the front side 17 of the housing 14 as shown in FIG. 2. The length of the edge brush bristles is such that they extend below the bottom side of the housing 14 to contact the surface 22 to be cleaned. In one embodiment, the mounting plate 26 is 4 millimeters from the surface 22 to be cleaned. The bristle length of the edge brush 28 is longer than the distance between the mounting plate 26 and the surface 22. In a preferred embodiment, the bristle length of the edge brush 28 is in a range from 3 millimeter to 12 millimeters.

In one embodiment, the cleaning head 12 includes one mounting plate 26 and edge brush 28 attached adjacent the first lateral side 27 of the housing 14. In another embodiment, the cleaning head 12 includes two mounting plates 26 and edge brushes 28, respectively attached adjacent to each lateral side 27 and 29 of the housing 14.

In one embodiment, the mounting plate 26 is removably attached to the housing 14. The mounting plate 26 may be attached to the housing 14 by sliding engagement with one or more grooves on the housing 14. In one embodiment, the mounting plate 26 is removed by sliding the mounting plate 26 in the lateral direction, away from the brushroll 24 and brushroll chamber 30 and out of the one or more grooves on the housing 14. In another embodiment, the mounting plate 26 is retained on the housing 14 by a snap-fit engagement. The mounting plate 26 may have a first engaging member that engages a second engagement member of the housing 14 in a snap-fit engagement. In one embodiment, the mounting plate 26 is attached to the housing 14 by one or more screws 63. In an alternate embodiment, the mounting plate 26 is integrally molded with the housing 14. The mounting plate 26 has a thickness between 0.15 millimeters and 5 millimeters. More particularly, the mounting plate 26 has a thickness between 0.5 millimeters and 3 millimeters.

To facilitate attachment to the mounting plate, the edge brush 28 may include a base to which the bristles are attached. In one example, the base is the backing or ground fabric supporting the bristle fibers. In another embodiment, the base includes a molded plastic member, a fabric, a metal strip, or other base as desired for the application. Bristles are attached to the base so that they are aligned in a continuous configuration when attached to the mounting plate.

In one embodiment, the edge brush 28 is sewn to the mounting plate 26. In this embodiment, the mounting plate 26 has a thickness between 0.15 millimeters and 0.75 millimeters where the edge brush 28 is sewn. In one embodiment, the edge brush 28 is removably attached to the mounting plate 26 by sliding engagement with one or more grooves 34 on the mounting plate 26 such as a T-slot, a dovetail, tongue and groove slot, or other desired slot shape. The edge brush 28 is received within the slot or groove 34 and is slidable relative to the mounting portion 26. In another embodiment, the edge brush 28 may be glued to the groove 34 or another portion of the mounting plate. In yet another embodiment, edge brush bristles are tufted into holes formed in the mounting plate 26.

The edge brush 28 may be angled such that the bristles extend outwardly from the mounting plate 26 and housing 14 at an angle. In one embodiment, the edge brush 28 is configured to extend beyond the lateral sides of the housing 14. In one embodiment, the edge brush 28 includes a contiguous row of bristles, for example a continuous pile fabric. In one embodiment, the edge brush 28 includes bristle tufts arranged in a row of tufts.

The bristles of the edge brush 28 can be selected or manufactured from any existing bristle material, with the bristle softness or stiffness being selected based on user demands. In one embodiment, the bristle fibers of the edge brush includes a microfiber material. In the present specification and appended claims, microfiber is not limited to fiber diameter less than 1 denier and generally includes fibers of less than 1 denier and greater than 1 denier. The bristles may be made from a polymer material such as nylon, polyester, polyethylene terephthalate, polypropylene, or other polymer fibers. In one embodiment, the edge brush 28 is composed of hydrophobic fibers, such as hydrophobic nylons, polyesters, polyolefins, or other hydrophobic fibers. The fibers can be made from any hydrophobic materials such as a flouropolymer such as polytetrafluoroethylene in one embodiment. In another embodiment, the fibers are coated with a hydrophobic coating or otherwise treated to be hydrophobic.

In one embodiment, the brushroll 24 includes a pile fabric, for example a tufted pile, cut pile, loop fabric, velvet, or other pile fabric covering all or a portion of the brushroll 24, and the suction inlet 32 is formed between the pile fabric of the brushroll 24 and the rear edge of the opening of the brushroll chamber 30. In one embodiment, the pile fabric includes fibers having a length between 3 and 20 mm, and more particularly between 8 and 15 mm in length. In one embodiment, the pile fabric includes a fiber density between 10000 and 125000 fibers per square cm, and more particularly between 45000 and 90000. Other fiber lengths and fiber densities may be selected as desired for the application. In one embodiment, the fibers of the brushroll 24 includes a microfiber material. In one embodiment, the fibers of the brushroll 24 include a hydrophobic material.

In use, the edge brush 28 directs debris from the lateral side or sides of the floor cleaner 10 towards the suction inlet. As the cleaning head moves forward, debris encountered in the space 25 between the brushroll 24 and the lateral side are collected by the edge brush 28 and deflected along the edge brush 28 toward the suction inlet 32. In one embodiment, the angle of the edge brush 28 improves direction of the debris from the lateral side of the housing towards the suction inlet 32. This helps facilitate pick-up of dirt and debris in hard to reach areas, such as when the lateral side is adjacent a wall or object.

Various features and advantages of the invention are set forth in the following claims.

What is claimed is:

1. A floor cleaner comprising:

a housing including a front side, a rear side, a top side, a bottom side, a first lateral side, and a second lateral side;

a suction source;

a brushroll chamber having an opening in the bottom side of the housing, the opening having a front edge, a rear edge, a first lateral edge, and a second lateral edge;

a brushroll mounted in the brushroll chamber extending in a longitudinal direction between the first and second lateral edges and extending through the opening to contact a surface to be cleaned;

a suction inlet formed between the brushroll and the rear edge;

a recovery tank in fluid communication with the suction source and the suction inlet, the recovery tank configured to contain debris drawn by the suction source through the suction inlet from the surface to be cleaned; and an edge brush adjacent the bottom side of the housing, the edge brush having a first end, a second end, and a row of bristles between the first end and the second end, wherein the first end of the edge brush is adjacent the suction inlet and the second end of the edge brush is adjacent the first lateral side of the housing forward of the suction inlet, and wherein the edge brush extends in a diagonal direction relative to the longitudinal direction of the brushroll, extending in a direction along a plane which is parallel to the bottom side of the housing and also in a diagonal direction relative to a direction perpendicular to the longitudinal direction of the brushroll.

2. The floor cleaner of claim 1, further comprising a mounting plate attached to the bottom side of the housing adjacent the brushroll chamber, wherein the edge brush is attached to the mounting plate, and wherein the mounting plate is lateral of the brushroll chamber adjacent the first lateral side.

3. The floor cleaner of claim 1, wherein the brushroll includes a pile fabric and the suction inlet is formed between the pile fabric and the rear edge.

4. The cleaning head of claim 1, further comprising a mounting plate attached to the bottom side of the housing adjacent the brushroll chamber, wherein the edge brush is attached to the mounting plate, and wherein the mounting plate is removably attached to the housing by sliding engagement with one or more grooves on the housing.

5. The cleaning head of claim 1, further comprising a mounting plate attached to the bottom side of the housing adjacent the brushroll chamber, wherein the edge brush is attached to the mounting plate, and wherein the mounting plate is retained on the housing by snap-fit engagement.

6. The cleaning head of claim 1, further comprising a mounting plate attached to the bottom side of the housing adjacent the brushroll chamber, wherein the edge brush is attached to the mounting plate, and wherein the mounting plate is attached to the housing by one or more screws.

7. The cleaning head of claim 1, wherein the row of bristles of the edge brush are contiguous.

8. The cleaning head of claim 1, further comprising a mounting plate attached to the bottom side of the housing adjacent the brushroll chamber, wherein the edge brush is attached to the mounting plate, and wherein the edge brush is sewn to the mounting plate.

9. The cleaning head of claim 1, further comprising a mounting plate attached to the bottom side of the housing adjacent the brushroll chamber, wherein the edge brush is attached to the mounting plate, and wherein the edge brush is glued to the mounting plate.

10. The cleaning head of claim 1, wherein the edge brush includes a base configured to slidably engage a corresponding groove by a slide-groove fit.

11. The cleaning head of claim 1, further comprising a mounting plate attached to the bottom side of the housing adjacent the brushroll chamber, wherein the edge brush is attached to the mounting plate, and wherein the mounting plate has a thickness between 0.25 millimeters and 4 millimeters.

12. The cleaning head of claim 1, wherein the edge brush includes microfiber.

13. The cleaning head of claim 1, wherein the edge brush includes a hydrophobic material.

14. The cleaning head of claim 1, wherein the edge brush forms an angle between 30 and 45 degrees with respect to the front side of the housing.

15. The cleaning head of claim 1, wherein the edge brush includes a plurality of tufts.

16. The cleaning head of claim 1, wherein edge cleaning brush includes bristles that extend toward the surface to be cleaned, and are between 3 millimeters and 8 millimeters in length.

17. The cleaning head of claim 1, wherein the second end of the edge brush extends beyond the lateral side of the housing.

18. The cleaning head of claim 1, further comprising a mounting plate attached to the bottom side of the housing adjacent the brushroll chamber, wherein the edge brush is attached to the mounting plate, and where the mounting plate is a first mounting plate, the cleaning head further comprising a second mounting plate including a second edge brush, wherein the second edge brush is adjacent the second lateral side.

19. A cleaning head for a floor cleaner comprising:

a housing including a front side, a rear side, a top side, a bottom side, a first lateral side, and a second lateral side;

a brushroll chamber having an opening in the bottom side, the opening having a front edge, a rear edge, a first lateral edge, and a second lateral edge;

a brushroll mounted in the brushroll chamber extending longitudinally between the first and second lateral edges and extending through the opening to contact a surface to be cleaned;

a suction inlet formed between the brushroll and the rear edge; and an edge brush adjacent the bottom side of the housing, the edge brush having a first end, a second end, and a row of bristles between the first end and the second end, wherein the first end of the edge brush is adjacent the suction inlet and the second end of the edge brush is adjacent the first lateral side of the housing forward of the suction inlet, and wherein the edge brush extends in a diagonal direction relative to a direction of forward motion of the floor cleaner and extending in a direction along a plane which is parallel to the bottom side of the housing.

20. A cleaning head for a floor cleaner comprising:

a housing with a front side, a rear side, a top side, a bottom side, a first lateral side, and a second lateral side;

a brushroll chamber in the bottom side having a front edge, a rear edge, a first lateral edge, and a second lateral edge, the brushroll chamber having an opening facing the bottom side;

a brushroll mounted in the brushroll chamber extending longitudinally between the first and second lateral edges, extending through the opening to contact a surface to be cleaned;

a suction inlet formed between the brushroll and the rear edge; and an edge brush adjacent the bottom side of the housing, the edge brush having a contiguous row of bristles extending from adjacent the suction inlet towards the lateral side of the housing, forward of the suction inlet, wherein the edge brush extends in a direction along a plane parallel to the bottom side of the housing and is disposed at an angle to the brushroll, and wherein the angle is between 30 and 75 degrees with respect to the front side of the housing.

21. The cleaning head of claim 18, wherein the mounting plate is integrally molded with the housing.

22. The cleaning head of claim 18, wherein the edge brush includes a base configured to slidably engage a corresponding groove in the mounting plate by a slide-groove fit.

23. The cleaning head of claim 20, wherein the edge brush is configured to guide dirt from a perimeter of the floor cleaner to the suction inlet as the floor cleaner moves in a forward direction.

* * * * *